US005947129A

United States Patent [19]

Bradshaw

[11] Patent Number: 5,947,129

[45] Date of Patent: Sep. 7, 1999

[54] DECORATIVE HAIR PIECE

[76] Inventor: Inge E. Bradshaw, 1265 Friendship La., Reno, Nev. 89512

[21] Appl. No.: 08/840,219

[22] Filed: Apr. 11, 1997

[51] Int. Cl.[6] ..... A41G 5/00

[52] U.S. Cl. ..... 132/54; 132/275

[58] Field of Search ..... 132/273, 275, 132/53, 54, 55; 2/126, 170, DIG. 11

[56] References Cited

U.S. PATENT DOCUMENTS

| | | | |
|---|---|---|---|
| 62,648 | 3/1867 | Lewine | 2/170 |
| 77,483 | 5/1868 | Hart | 2/170 |
| 541,125 | 6/1895 | Simonson | 132/54 |
| 615,389 | 12/1898 | Heagle et al. | 2/170 |
| 2,595,657 | 5/1952 | Harmon | 132/273 |
| 3,126,020 | 3/1964 | Sidelman | 132/54 |
| 3,456,657 | 7/1969 | Smith | 132/53 |
| 3,750,683 | 8/1973 | Desell | 132/55 |
| 5,172,428 | 12/1992 | Leinoff | 2/DIG. 11 |
| 5,379,782 | 1/1995 | Tabb | 132/273 |
| 5,647,384 | 7/1997 | Haber et al. | 132/275 |

FOREIGN PATENT DOCUMENTS

| | | | |
|---|---|---|---|
| 183519 | 10/1955 | Austria | 132/275 |
| 11302 | 1/1901 | United Kingdom | 132/55 |
| 2107181 | 4/1983 | United Kingdom | 132/53 |

*Primary Examiner*—Todd E. Manahan
*Attorney, Agent, or Firm*—Charles Hartman

[57] ABSTRACT

A decorative hair piece made in the form of a hollow cylindrical member allows the wearer to place their hair in the central void defined by the inner surface of the cylindrical member. A plurality of fibers attached to the outer surface of the member cascade down the gathered hair not in the cylinder, which hair is smoothly disposed on the scalp of the wearer. The hair placed through the void cascades on top of the plurality of fibers.

20 Claims, 1 Drawing Sheet

FIG. 1
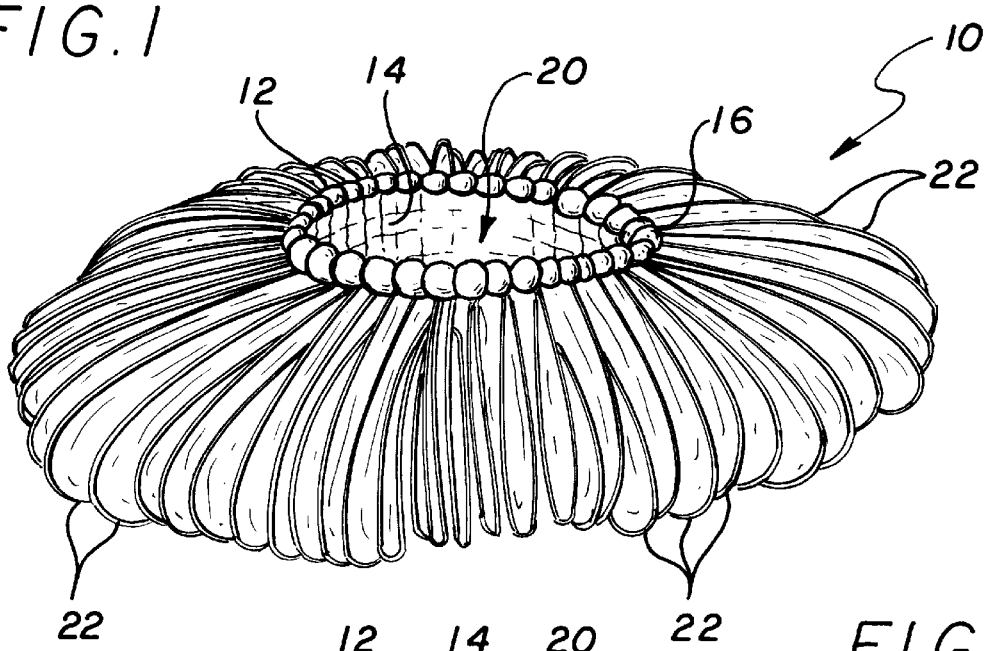
FIG. 2
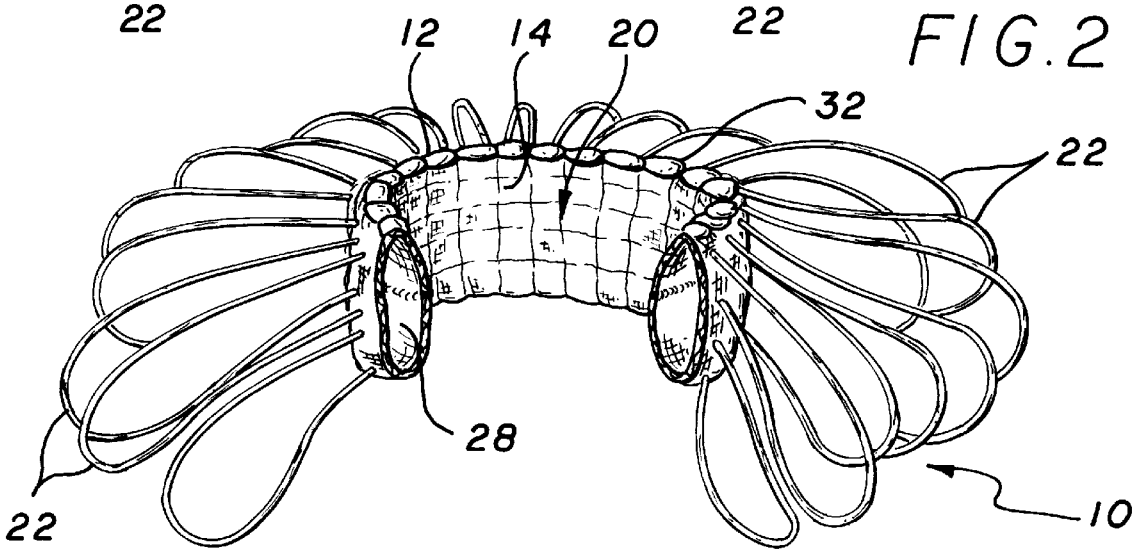
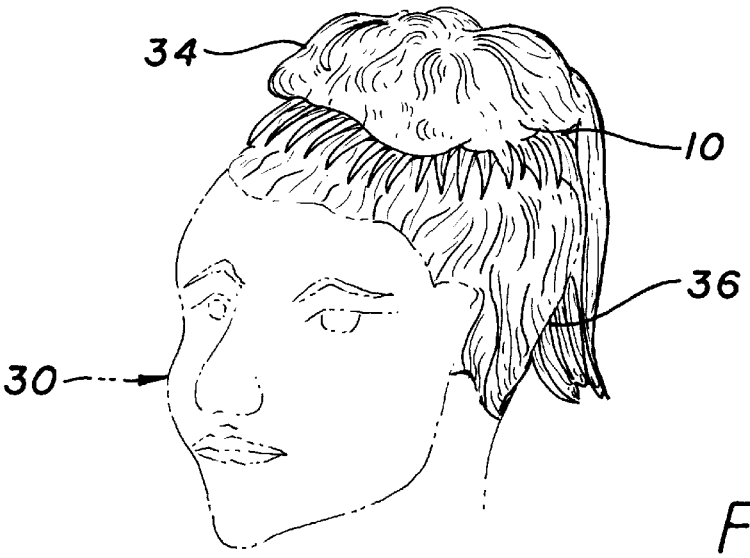
FIG. 3

DECORATIVE HAIR PIECE

BACKGROUND OF THE INVENTION

1. Field of the Invention

This invention relates to decorative fashion apparel, more particularly, this invention relates to fashionable and decorative hair retention pieces.

2. State of the Art

People have decorated and controlled long hair for millennia, using clips, bands and other devices to keep long hair in place, to keep it out of the face, and to provide some personal ornamentation. Hair controlling devices should, ideally, be decorative as well as functional, and to this end various decorative designs and ornaments have been added to the hair controlling device.

One approach is exemplified by Tabb in U.S. Pat. No. 5,379,782, which discloses a device to hold hair in a pony tail like arrangement. It is basically a flat device with a hole in the middle to hold hair. The hair is pulled through and the device sits more or less flat on the wearers head.

A similar approach is shown by Revson in U.S. Pat. No. 5,301,606. Again, an essentially flat device with a hole is used to position hair drawn through it.

One of the aims of many who wear hair retention devices is to increase the apparent amount of hair by piling it higher. Neither of these two devices can create that illusion, since they are flat. Clearly the need for a device that makes hair appear higher is needed.

BRIEF DESCRIPTION OF THE DRAWINGS

FIG. 1 shows a perspective view of one embodiment of this invention.

FIG. 2 shows a perspective and partially cutaway view of a second embodiment of this invention.

FIG. 3 shows a perspective view of the use of one embodiment of this invention.

SUMMARY OF THE INVENTION

This invention provides a decorative hair piece made in the form of a hollow cylindrical member allows the wearer to place their hair in the central void defined by the inner surface of the cylindrical member. A plurality of fibers attached to the outer surface of the member cascade down the gathered hair not in the cylinder, which hair is smoothly disposed on the scalp of the wearer. The hair placed through the void cascades on top of the plurality of fibers.

In an aspect of this invention, a decorative fashion accessory controls human hair comprising:

a hollow cylindrical member made of stretchable material;

a plurality of fibers attached to the hollow member;

wherein the hair of the wearer can be placed in the central void defined by the inner surface of the cylindrical member, allowing the plurality of fibers to cascade down the gathered hair not in the cylinder, which hair is smoothly disposed on the scalp of the wearer, and allowing the hair placed through the cylinder to cascade on top of the plurality of fibers.

In a second aspect of this invention, a decorative fashion accessory controls human hair comprising:

a toroidal member made of stretchable material;

a plurality of fibers attached to the outer surface of the toroidal member;

wherein the hair of the wearer can be placed in the central void defined by the toroidal surface, allowing the plurality of fibers to cascade down the gathered hair placed through the void of the torus, which hair is smoothly disposed on the scalp of the wearer, and allowing the hair placed through the cylinder to cascade on top of the plurality of fibers.

DETAILED DESCRIPTION OF THE PREFERRED EMBODIMENT

Referring to FIG. 1, the device 10 of this invention is generally in the form of a cylindrical member 12 having an inner surface 14 and an outer surface 16. The hollow cylindrical member 12 is radially stretchable and axially rigid enough to guide and uplift hair placed through the central void, or hole 20, defined by the inner surface 14 of the cylindrical member 12. A plurality of fibers 22 attached to the outer surface 14 of the cylindrical member 12 cascade down the gathered hair on the scalp of the wearer that is not in the cylinder. This hair is preferably smoothly disposed on the scalp of the wearer. The gathered hair placed through the void 20 cascades on top of the plurality of fibers.

Preferably the cylindrical member is made by such conventional techniques as knitting or crocheting. It can be made from any conventional yarn, such as wool or cotton. Such a knitted or crocheted member is slightly radially stretchable, but it is preferred that it be axially rigid. The axial rigidity allows the hair placed through the member to be uplifted off the scalp of the user. In another embodiment of this invention, the material of the cylindrical member is made from woven, but slightly stretchy material, such as polyurathane like materials, such as Spandex.

The cylindrical member 12 has a plurality of fibers 22 attached to its outer surface 16. These fibers can be made of the same material as the cylindrical member, or they can be made of different material. One preferred fibrous material is hair. The hair can be artificial hair, or it can be natural human hair. The choice of the fiber to be used is largely dictated by the desired effect the user desires. The fiber can be woven onto the support for the hair piece, or they can be attached, by glue or similar means. Yarn and similar fibers are clearly identifiable as such when the user wears the device, while hair is blended into and intermingled with the hair already present on the scalp of the user.

Referring now to FIG. 2, the ends of the cylindrical member 12 have been turned around and joined to form a generally toroidal support piece 28. The toroidal support piece formed has a plurality of fibers 22 on the outside surface of the torus 32. The fibers may be disposed all the way around the torus, or they may be disposed only on the outside surface of the toroidal support piece. The toroidal support piece is made form the same materials as discussed above. although in the case of the torus, since the material is doubled, thereby increasing the total strength of the final product, a more delicate fabric may be used in the construction of the torus than would be appropriate for the cylindrical member. One preferred material is knitted nylon mesh.

The fibers are attached to the fabric of the torus as they would be in the case of the cylindrical member. Conventional techniques may be used for fiber attachment, such as those used to attach fibers to wigs.

Referring to FIG. 3, the device 10 is worn on the head of the wearer 30 (shown in phantom). Preferably the device is worn nearly at the top of the head, so the gathered hair projects upwardly from the scalp of the user 36 and cascades down the head of the user 34.

In use, the user will first gather the hair to be placed through the device into a pony tail and secure the pony tail with an elastic band. The pony tail need not be particularly tightly bundled, to prevent breaking of the hair fibers of the wearer. The loosely bundled pony tail is placed through the center hole of the device. The fibers on the outer surface of the device are arranged around the scalp of the user, on top of the hair smoothed down from the gathering of the pony tail. The hair protruding through the top of the device is then smoothed into the fibers. If the fibers are hair, they may be blended into the hair protruding from the top of the device. If the fibers are yarn or similar non-hair fibers, the hair protruding from the top of the device may be placed on the fibers, to create a textured and layered look.

Although this invention has been primarily described in terms of specific examples and embodiments thereof, it is evident that the foregoing description will suggest many alternatives, modifications, and variations to those of ordinary skill in the art. Accordingly, the appended claims are intended to embrace as being within the spirit and scope of invention, all such alternatives, modifications, and variations.

I claim:

1. A decorative fashion accessory to control human hair comprising:

a hollow cylindrical member made of stretchable material having axial rigidity;

a plurality of fibers attached to the hollow member;

wherein the hair of the wearer can be placed in a central void defined by the inner surface of the cylindrical member, the rigidity of the cylindrical member lifting the hair off the wearers scalp, the plurality of fibers cascading down the gathered hair not in the cylinder smoothly disposed on the scalp of the wearer, and allowing the hair placed through the cylinder and raised off the scalp of the user to cascade on top of the plurality of fibers.

2. The decorative fashion accessory of claim 1 wherein the cylindrical member is made of knit material.

3. The decorative fashion accessory of claim 2 wherein the knit hollow cylindrical member is made of a yarn and the plurality of fibers comprise the same yarn used to make the knitted cylindrical member.

4. The decorative fashion accessory of claim 2 wherein the plurality of fibers are hair.

5. The decorative fashion accessory of claim 4 wherein the plurality of fibers are artificial hair.

6. The decorative fashion accessory of claim 4 wherein the plurality of fibers are human hair.

7. The decorative fashion accessory of claim 1 wherein the cylindrical member is made of crocheted material.

8. The decorative fashion accessory of claim 7 wherein the crocheted cylindrical member is made of a yarn and the plurality of fibers comprise the same yarn used to make the knitted cylindrical member.

9. The decorative fashion accessory of claim 7 wherein the plurality of fibers are human hair.

10. The decorative fashion accessory of claim 1 wherein the cylindrical member is made of woven stretch material.

11. The decorative fashion accessory of claim 10 wherein the woven stretch material is made from stretch polyurethane material.

12. The decorative fashion accessory of claim 11 wherein the woven stretch material comprises a yarn and the plurality of fibers comprise the same yarn.

13. The decorative fashion accessory of claim 11 wherein the plurality of fibers are human hair.

14. A decorative fashion accessory to control human hair comprising:

a toroidal member made of stretchable material having axial rigidity and a central void;

a plurality of fibers attached to the outer surface of the toroidal member;

wherein the hair of the wearer can be placed in the central void defined by the toroidal surface, allowing the plurality of fibers to cascade down the gathered hair placed through the void of the torus, which hair is smoothly disposed on the scalp of the wearer, and allowing the hair placed through the cylinder and raised off the scalp of the user by the axially rigid toroidal memeber to cascade on top of the plurality of fibers.

15. The decorative fashion accessory of claim 14 wherein the cylindrical member is made of knit material.

16. The decorative fashion accessory of claim 15 wherein the knit cylindrical member is made from a yarn and the plurality of fibers comprise the same yarn used to make the knitted cylindrical member.

17. The decorative fashion accessory of claim 15 wherein the plurality of fibers are human hair.

18. The decorative fashion accessory of claim 14 wherein the plurality of fibers are on an outer surface of the toroidal member.

19. The decorative fashion accessory of claim 14 wherein the plurality of fibers are on the entire surface of the toroidal member.

20. The decorative fashion accessory of claim 14 wherein the plurality of fibers comprise a plastic material and are attached to the outer surface of the toroidal member by gluing.

* * * * *